US011219248B2

(12) United States Patent
Young et al.

(10) Patent No.: US 11,219,248 B2
(45) Date of Patent: Jan. 11, 2022

(54) THERAPUETIC WEIGHTED ARTICLE OF CLOTHING

(71) Applicant: RestVest LLC, Danbury, CT (US)

(72) Inventors: Samuel Young, Wilton, CT (US); Jordan Young, Wilton, CT (US)

(73) Assignee: RESTVEST LLC, Danbury, CT (US)

( * ) Notice: Subject to any disclaimer, the term of this patent is extended or adjusted under 35 U.S.C. 154(b) by 126 days.

(21) Appl. No.: 16/857,273

(22) Filed: Apr. 24, 2020

(65) Prior Publication Data

US 2020/0337392 A1 Oct. 29, 2020

Related U.S. Application Data

(60) Provisional application No. 62/838,441, filed on Apr. 25, 2019.

(51) Int. Cl.

| | |
|---|---|
| ***A41D 31/32*** | (2019.01) |
| ***A41D 1/04*** | (2006.01) |
| ***A41D 13/00*** | (2006.01) |

(52) U.S. Cl.

CPC ..... *A41D 1/04* (2013.01); *A41D 13/0012* (2013.01); *A41D 2400/32* (2013.01)

(58) Field of Classification Search

CPC ... A41D 1/04; A41D 13/0012; A41D 2400/32

See application file for complete search history.

(56) References Cited

U.S. PATENT DOCUMENTS

| | | | | |
|---|---|---|---|---|
| 2,462,361 | A * | 2/1949 | Cassens | A41D 13/01 2/108 |
| 3,459,179 | A * | 8/1969 | Olesen | A47C 27/12 601/134 |
| 3,758,192 | A * | 9/1973 | Bingham | G02B 5/128 359/538 |
| 5,415,222 | A * | 5/1995 | Colvin | F28D 20/02 165/46 |
| 6,032,300 | A * | 3/2000 | Bainbridge | A41D 13/015 2/456 |
| 2017/0042260 | A1* | 2/2017 | Samuelsen | F21L 4/00 |
| 2020/0238045 | A1* | 7/2020 | Pacheco | A47G 9/0223 |

* cited by examiner

*Primary Examiner* — Tajash D Patel

(74) *Attorney, Agent, or Firm* — Cantor Colburn LLP

(57) ABSTRACT

An article of clothing and a method of manufacture thereof, where, the article of clothing includes a weighted material inconspicuously disposed within a material forming the article, where the weighted material is configured to apply a therapeutic pressure to the body of a user when the article of clothing is worn.

17 Claims, 12 Drawing Sheets

THERAPUETIC WEIGHTED ARTICLE OF CLOTHING

CROSS REFERENCE TO RELATED APPLICATION

This application is related to and claims the benefit of U.S. Provisional Patent Application No. 62/838,441 filed on Apr. 25, 2019, the entire contents of which are incorporated herein by reference.

TECHNICAL FIELD

This disclosure pertains to articles of clothing worn by persons and, particularly, an article of clothing with discrete weighted areas that are disposed to align with and to provide a therapeutic pressure upon a predetermined part of the body of a person wearing the article of clothing.

BACKGROUND

Weighted blankets have become increasingly popular and are known to provide a comforting pressure upon the body of a user. So called lightning jackets are used on pets, particularly dogs, to provide a similar comforting and calming pressure upon the animal. Recent research has shown the effectiveness of such pressure on treating conditions in humans such as anxiety, depression, post traumatic stress disorder (PTSD), autism spectrum disorder (ASD), attention deficit hyperactivity disorder (ADHD), mental noise brought on by the increasing use of technology, and other mental health challenges. However, existing solutions are primarily pharmacological and attempts to provide treatment through therapeutic pressure involve a medical device which is worn over the clothing of the patient in a publicly revealing and non-discrete manner. Unfortunately, such blatant medical devices generate stigma and thus, even where prescribed, are not worn by the patients thus preventing any intended treatments and benefits.

An article of clothing is needed which discretely and inconspicuously includes weighted areas that are disposed to align with and to provide a therapeutic pressure upon a predetermined part of the body of a person wearing the article of clothing, where the article is comfortable and fashionable on the one hand and therapeutically effective at the same time.

BRIEF SUMMARY

An article of clothing is provided which includes a weighted material inconspicuously disposed within a material forming the article of clothing, where the weighted material is configured to apply a therapeutic pressure to the body of a user when the article of clothing is worn.

A method of manufacturing an article of clothing is further provided herein, where the method includes disposing an interior material between a liner material and an outermost material, delimiting the interior material into a plurality of chambers wherein each chamber is spatially isolated from the others, and disposing a weighted material within at least some of the chambers in a portion of the article of clothing arranged to apply a therapeutic pressure to the body of a user when the article of clothing is worn.

Also provided herein is a method of applying a therapeutic pressure to a person, the method including inconspicuously disposing a weighted material within an article of clothing, and applying the article of clothing to the person so that the weighted material bears on a predetermined area of a body of the person.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

An article of clothing is provided herein which, in one embodiment, is a premium weighted vest that provides stress and anxiety relief while enhancing mental focus in a holistic method. The vest is designed in a stylish and contemporary way that distances its public use image from that of a medical device.

The vest is designed for discrete use in both public and private settings. The vest has enhanced the aesthetic appeal while secretly incorporating micro-glass beads for the functional weight. The beads are in pockets or chambers that have been sewn in to the vest. The vest is constructed with premium choice fabrics and materials that are synonymous with luxury quality and fashionable appeal. The vest is designed to be worn as a component to everyday wardrobe. People will see fashion while the user feels the therapeutic function, reducing the stigma and anxiety attached with wearing a traditional medical device in public.

With the dramatic rise in daily use of technology, social media and video content, there has been a connection established to the increase of stress, anxiety and 'mental noise.' People's attention is simultaneously being pulled in various and competing directions. The vest described herein is designed as a simple solution to combat these issues and allow users to decompress and focus on the task at hand, even if the task is simply to relax. The audience broadens significantly to include people suffering from mental health challenges and PTSD.

Deep pressure therapy has been proven to effectively reduce stress and anxiety and this calming effect leads to mental focus. As we begin to understand the negative health effects of stress on the body there has been a huge increase in the amount of products available to help alleviate stress. According to the American Psychological Association stress in America is increasing. Many Americans are suffering from moderate to high stress yet only 37% are receiving treatment. Clinical studies have proven the effectiveness of deep pressure therapy in mental health institutions. One of the major issues our country is facing is the rise of undiagnosed mental health challenges and having non-pharmacological solutions. The disclosed vest is simply designed to meet this growing need in a way that users can feel good about wearing the product in social environments without any stigma attached.

Figure 1:
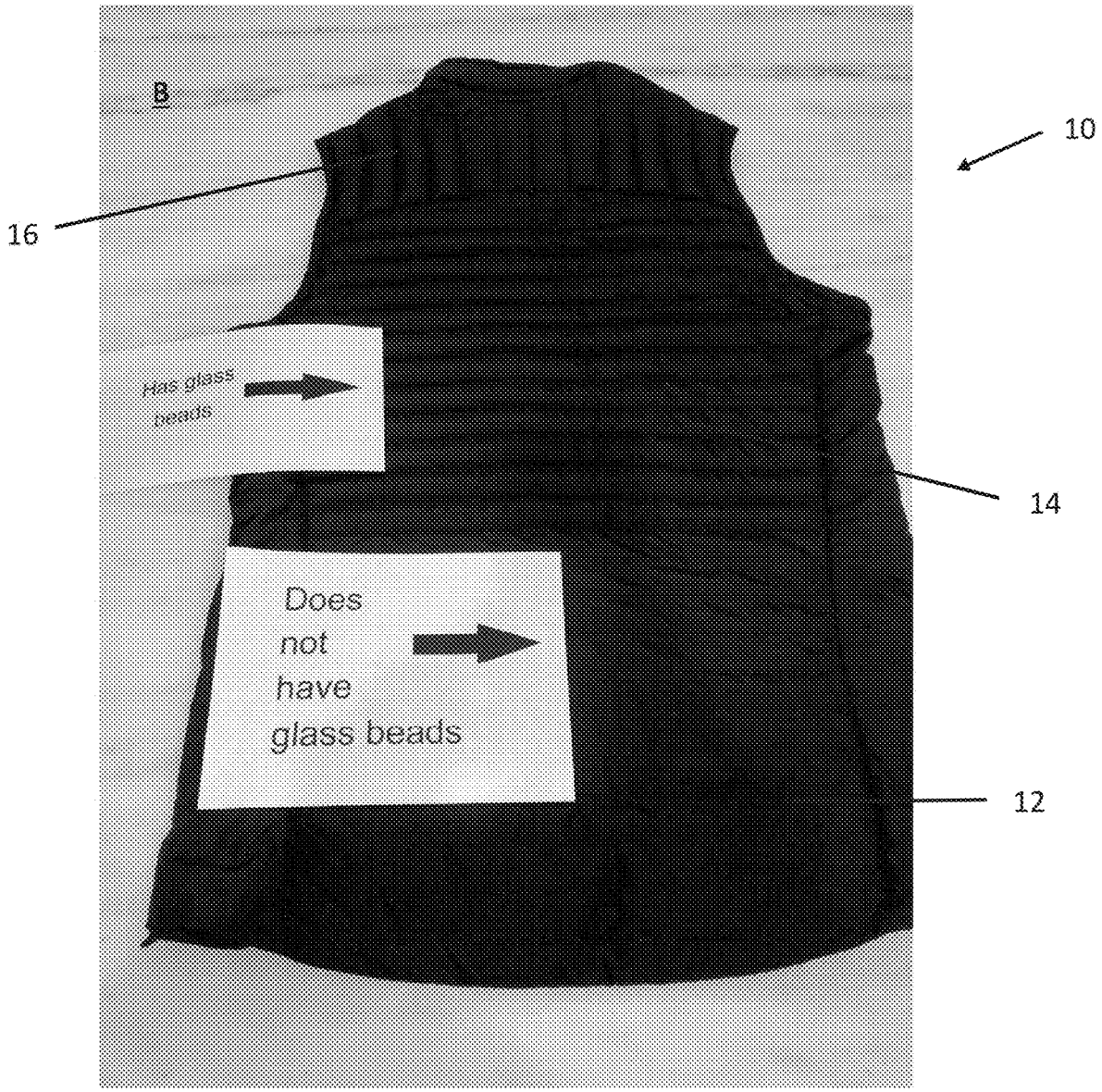
FIGS. 1-6 provide various views of therapeutic weighted vest in one exemplary embodiment of the invention.
Figure 2:
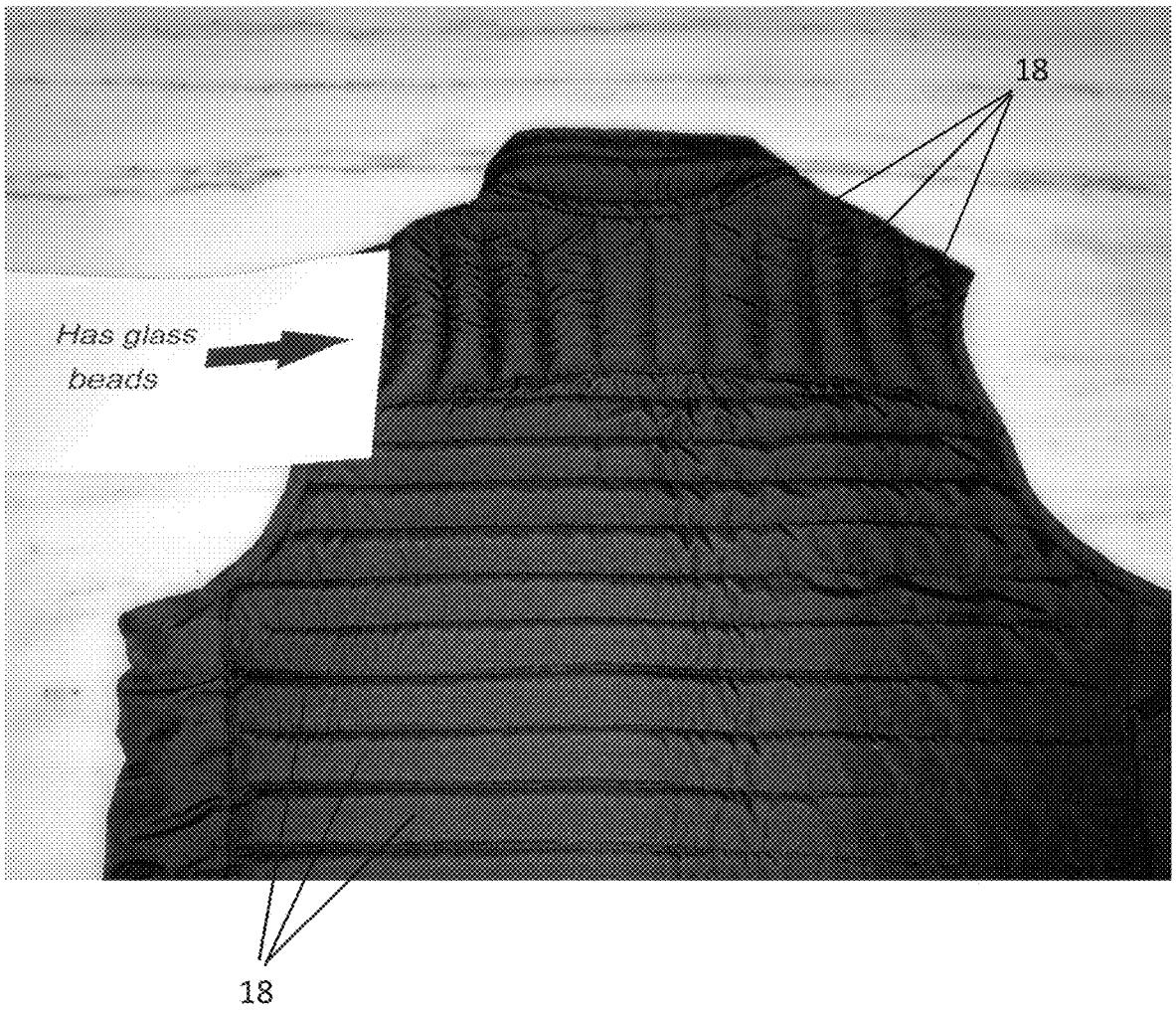

FIGS. 1-7 show an article of clothing in one non-limiting exemplary embodiment of the disclosure. Here, the article of clothing is a vest 10. FIG. 1 illustrates a back B of the vest 10 where a lower back area 12, an upper back area 14, and a shoulder area 16 are located. FIG. 2 shows an enlarged image of the upper back 14 and shoulder area 16 of the vest 12. As can be seen clearly in FIG. 2, the upper back area 14 and the shoulder area 16 of the vest 10 both include a plurality of chambers 18. As shown, the chambers 18 are elongated rectilinear shaped compartments which extend generally horizontally across the upper back area 14 and generally vertically over the shoulder area 16.

Figure 3:
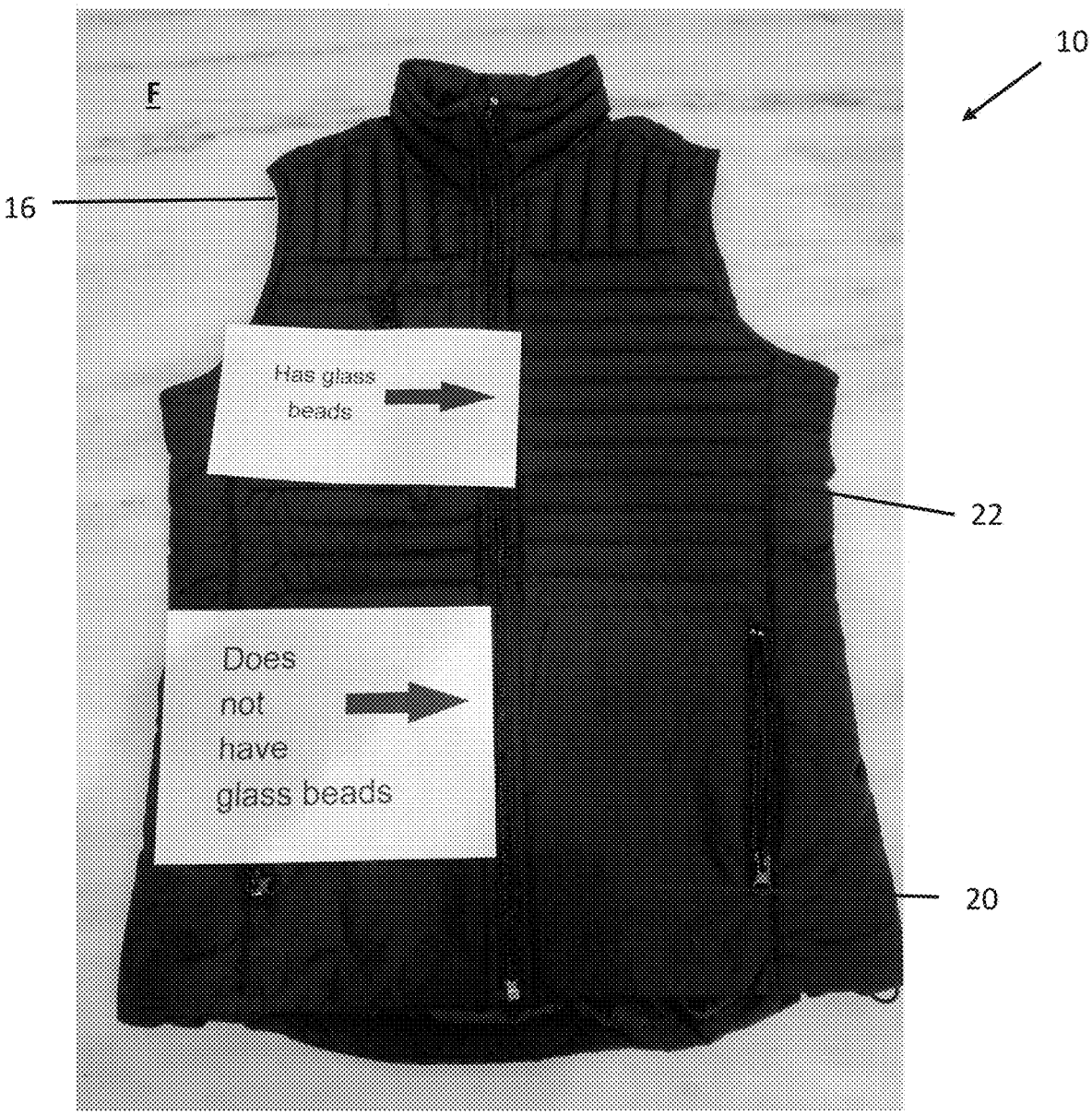
Figure 4:
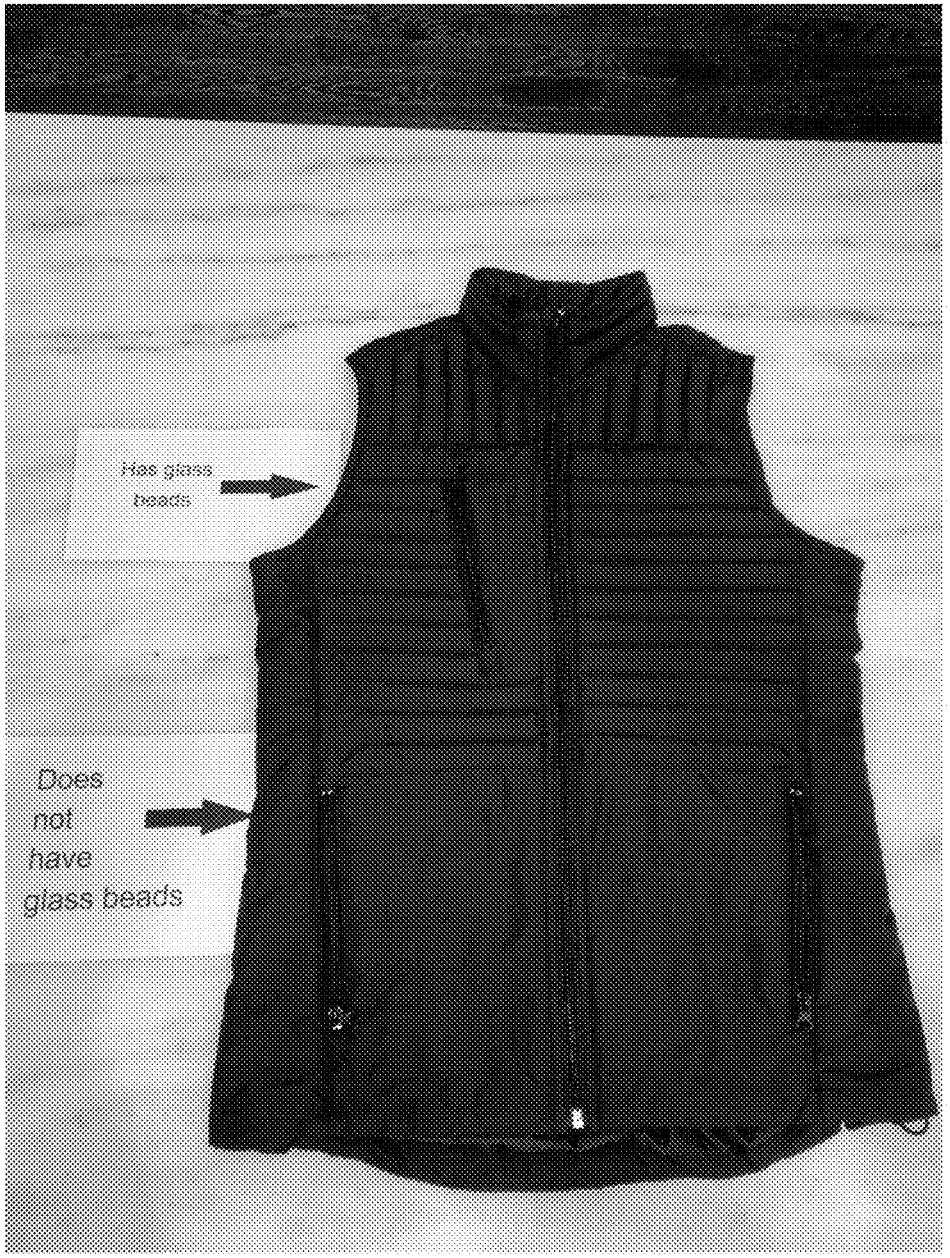
Figure 5:
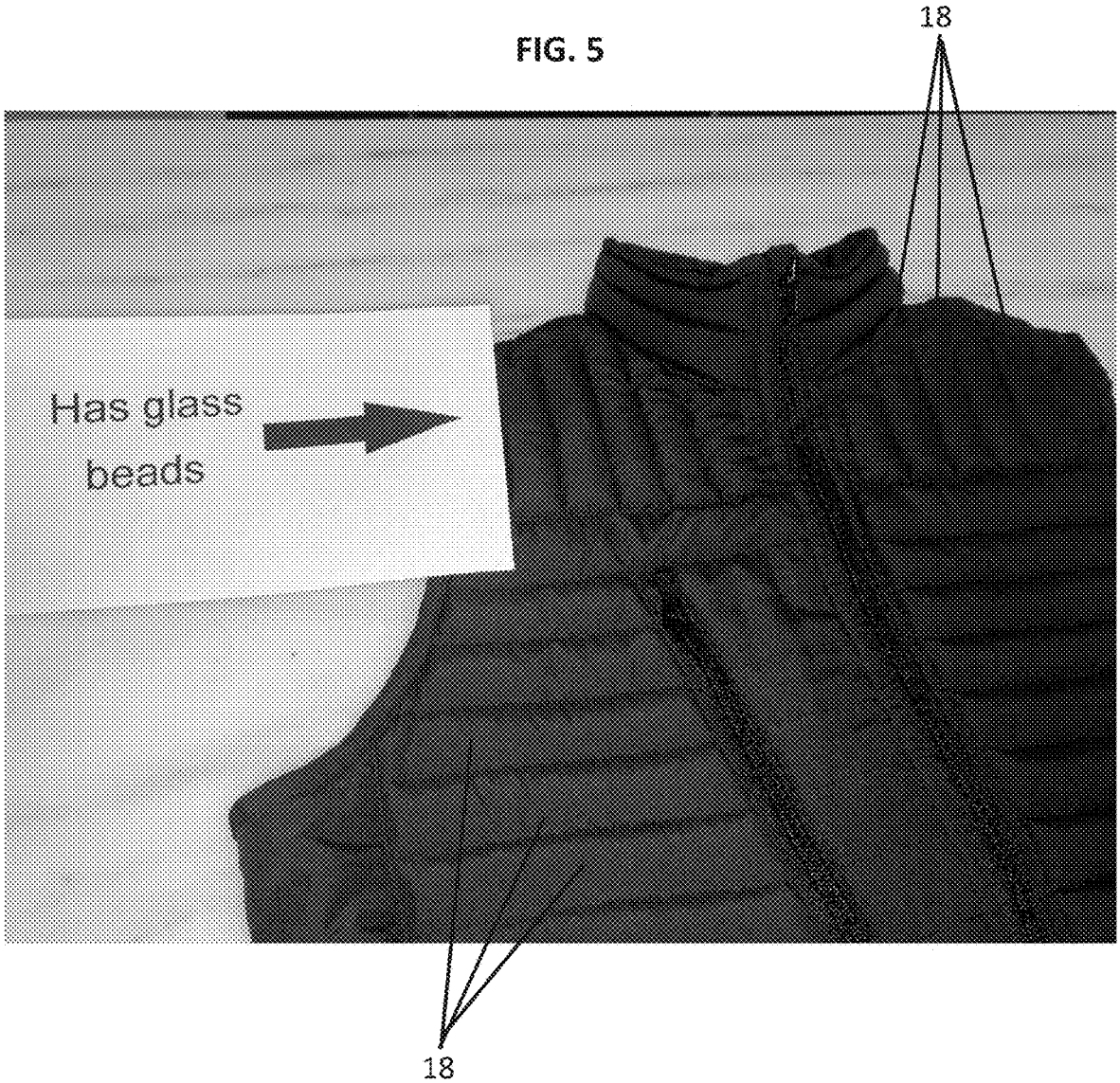
Figure 6:
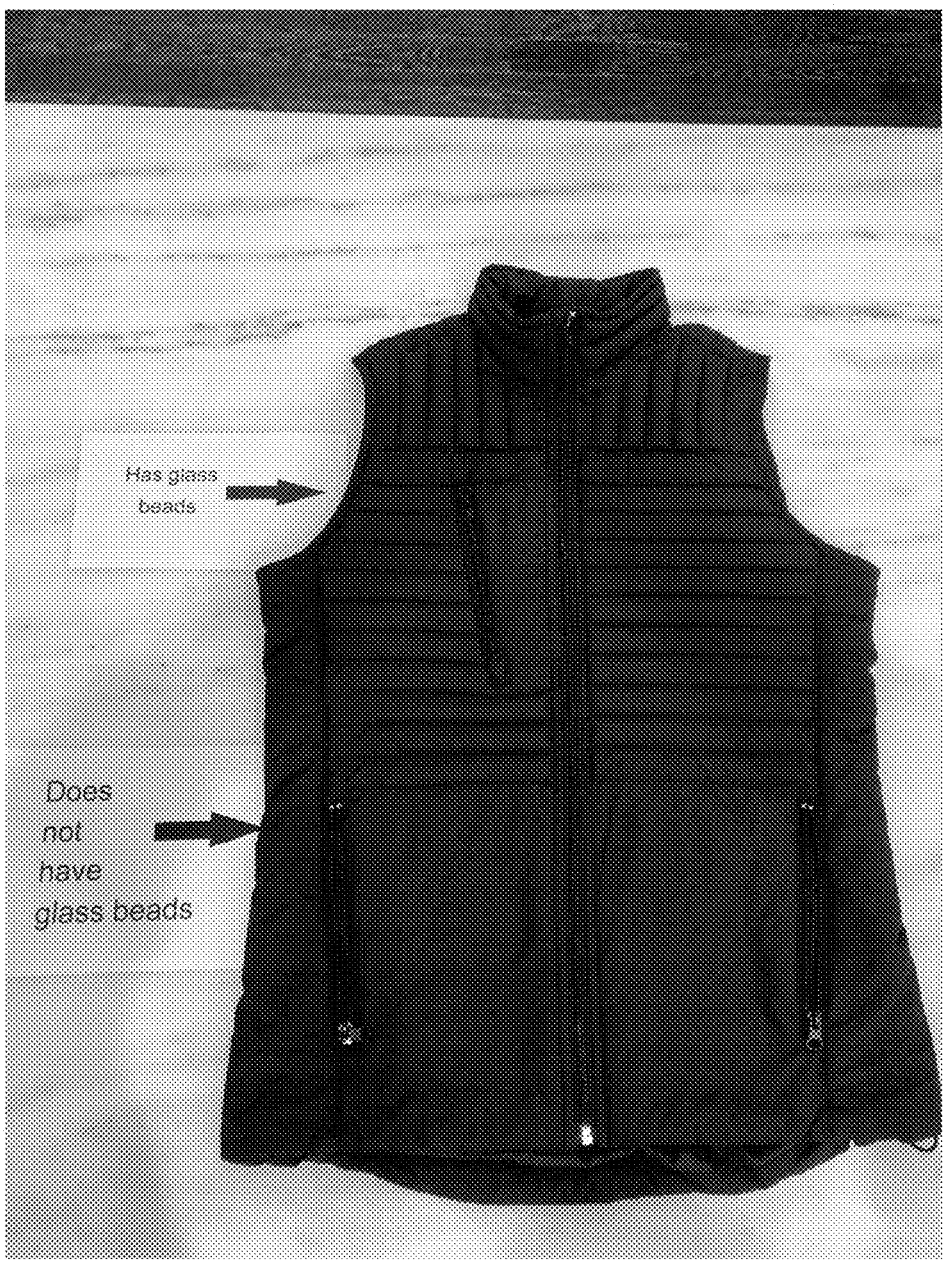
Figure 7:
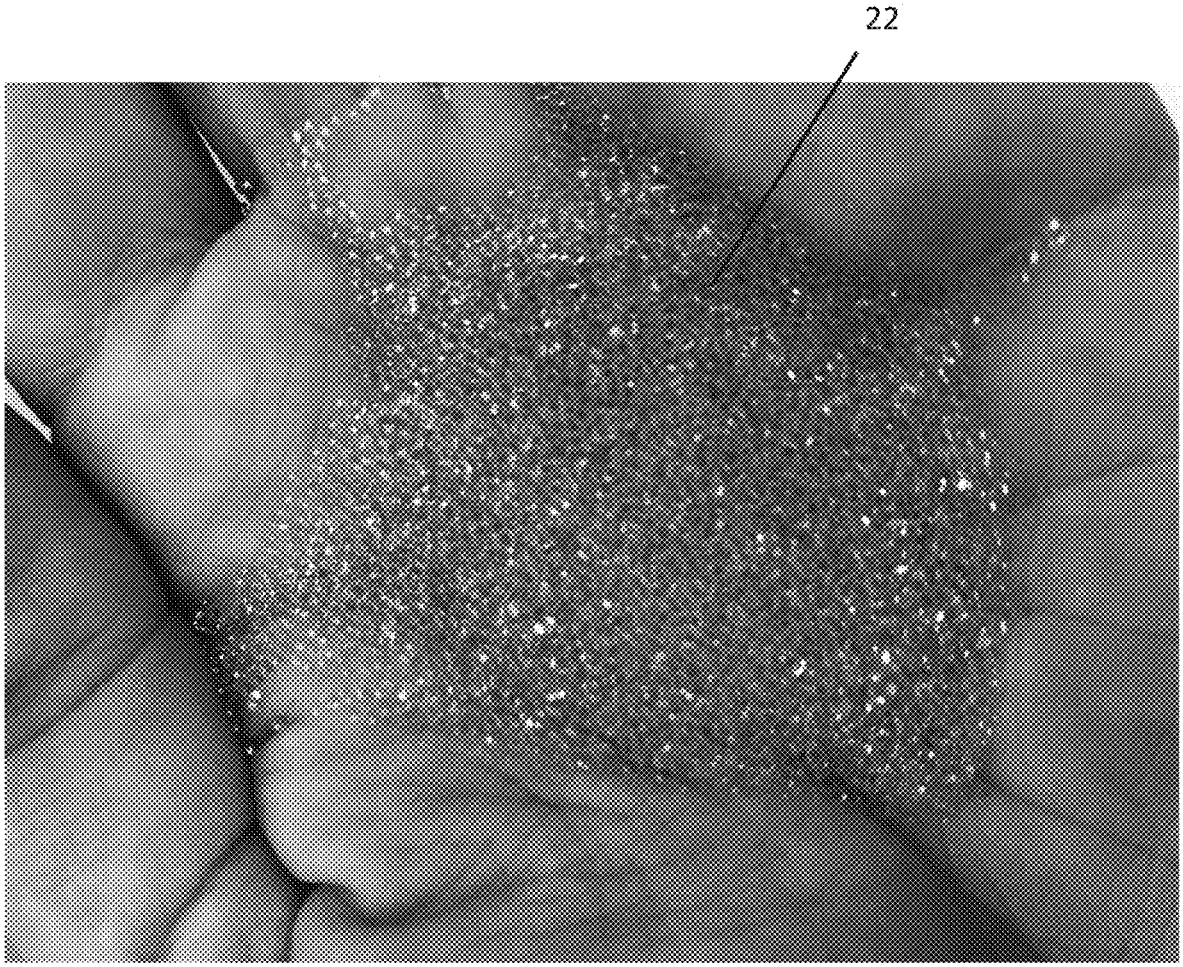
FIGS. 7-8 show a weighted material comprising glass micro-beads in one exemplary embodiment of the invention.

FIGS. 3-4 show a front F of the vest 10 which includes a stomach area 20 and a chest area 22. The shoulder area 16 extends from the back B of the vest 10 to the front F, as shown. FIG. 5 illustrates an enlarged view of the front F of the vest 10. The chest area 22 and the frontal region of the shoulder area 16 both include the chambers 18 which extend generally horizontal across the chest area 22 and vertically over the shoulder area 16. In other embodiments, the chambers 18 may be arranged transverse or otherwise angled relative to their illustrated disposition. Still in other embodiments, the chambers 18 may shaped generally as a square, triangle, or circle, or any modification, abstraction, or combination thereof.

The vest 10 includes a variety of fashionable and functional elements, as shown in the drawings, such as a central zipper allowing for closure of the vest around the body of a person, two zipper hand pockets, and a zipper chest pocket.

Figure 8:
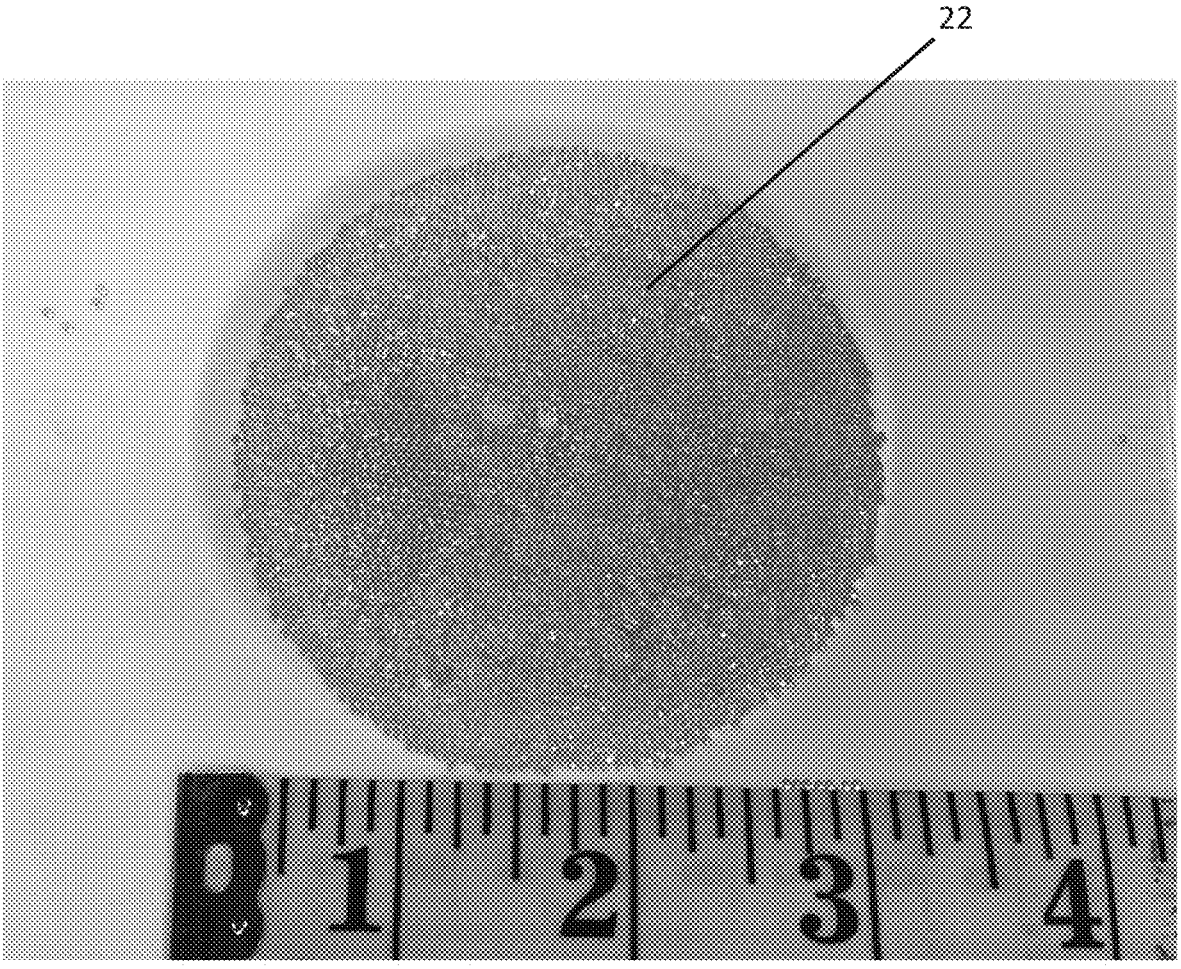
Figure 9:
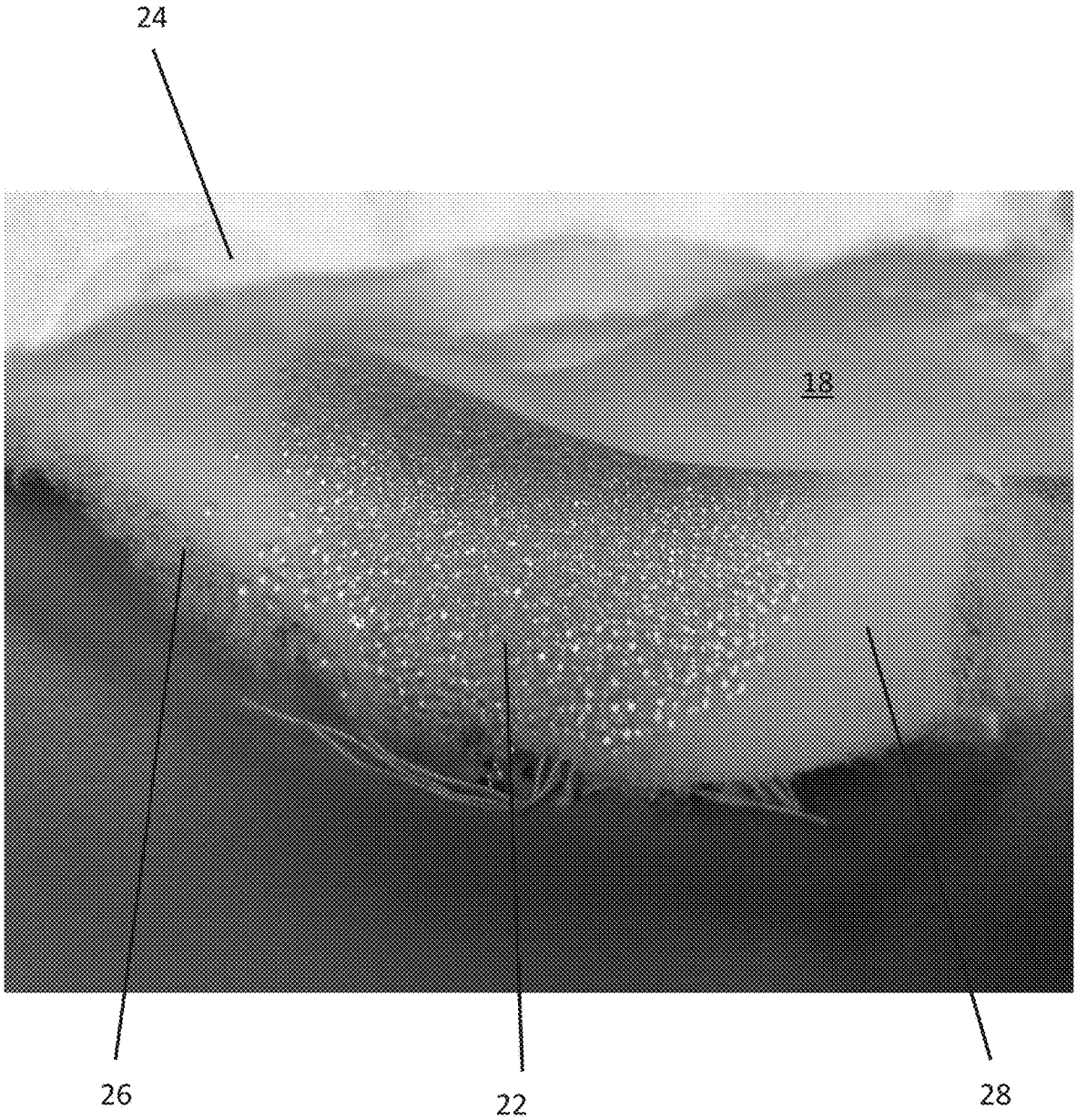
FIGS. 9-12 show cross-sectional views of a chamber of the vest in one exemplary embodiment of the invention.
Figure 10:
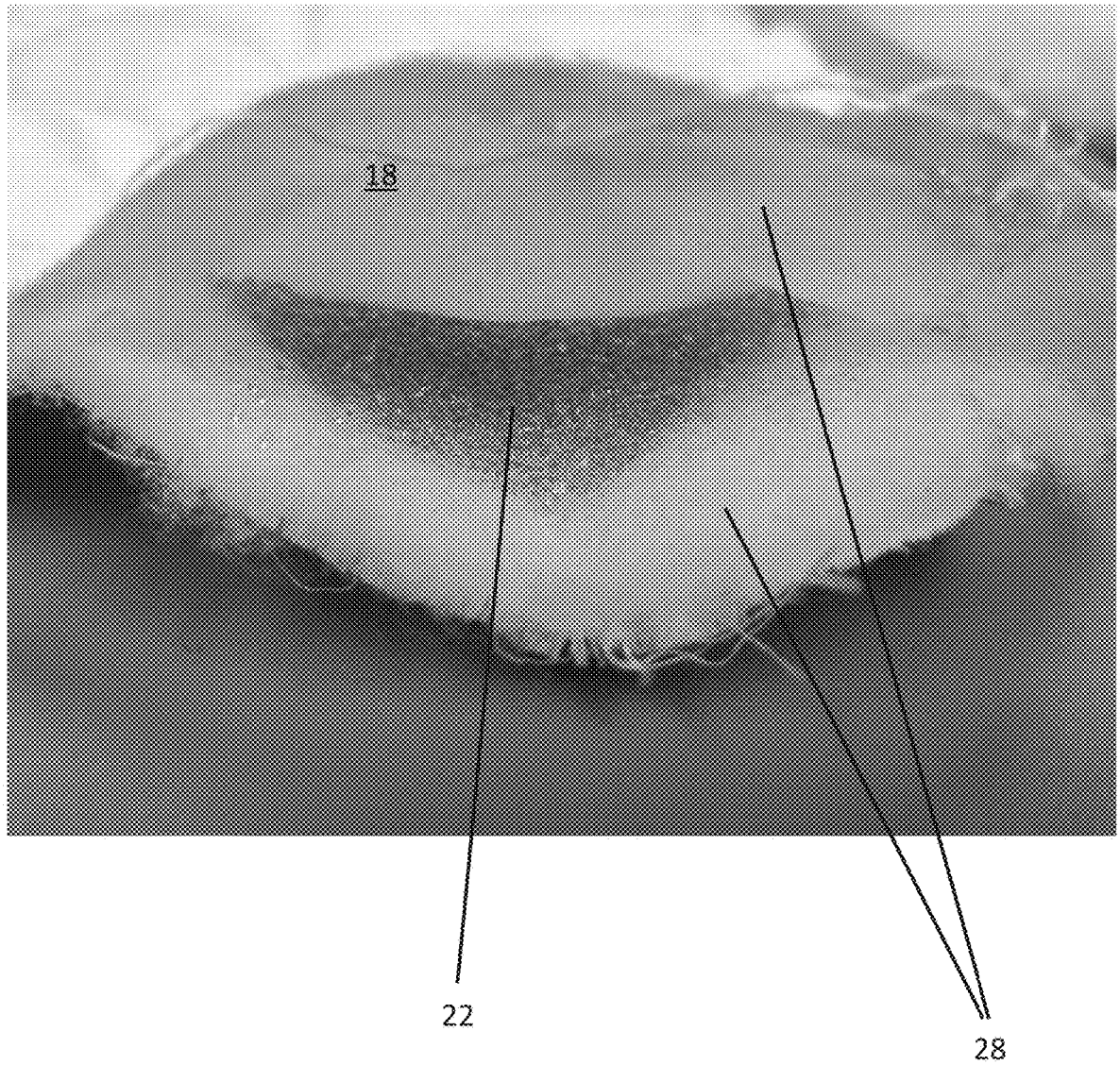
Figure 11:
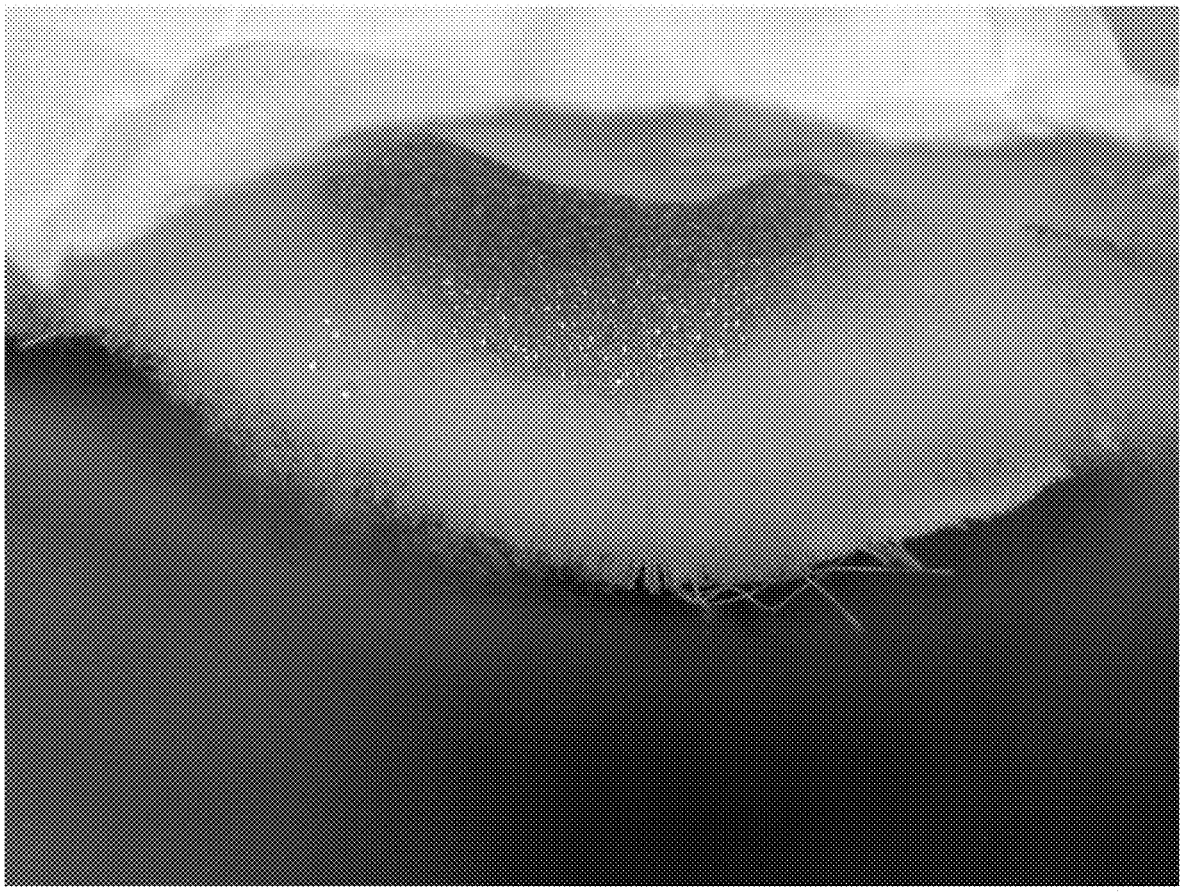

The chambers 18 are configured to hold and retain weighted elements 22. See, FIGS. 7-8. In the illustrated exemplary embodiment the weighted elements 22 comprise glass beads and, more specifically, micro-glass beads made of a high density glass material. Each glass micro-bead has a diameter that is a small fraction of a quarter inch.

Figure 12:
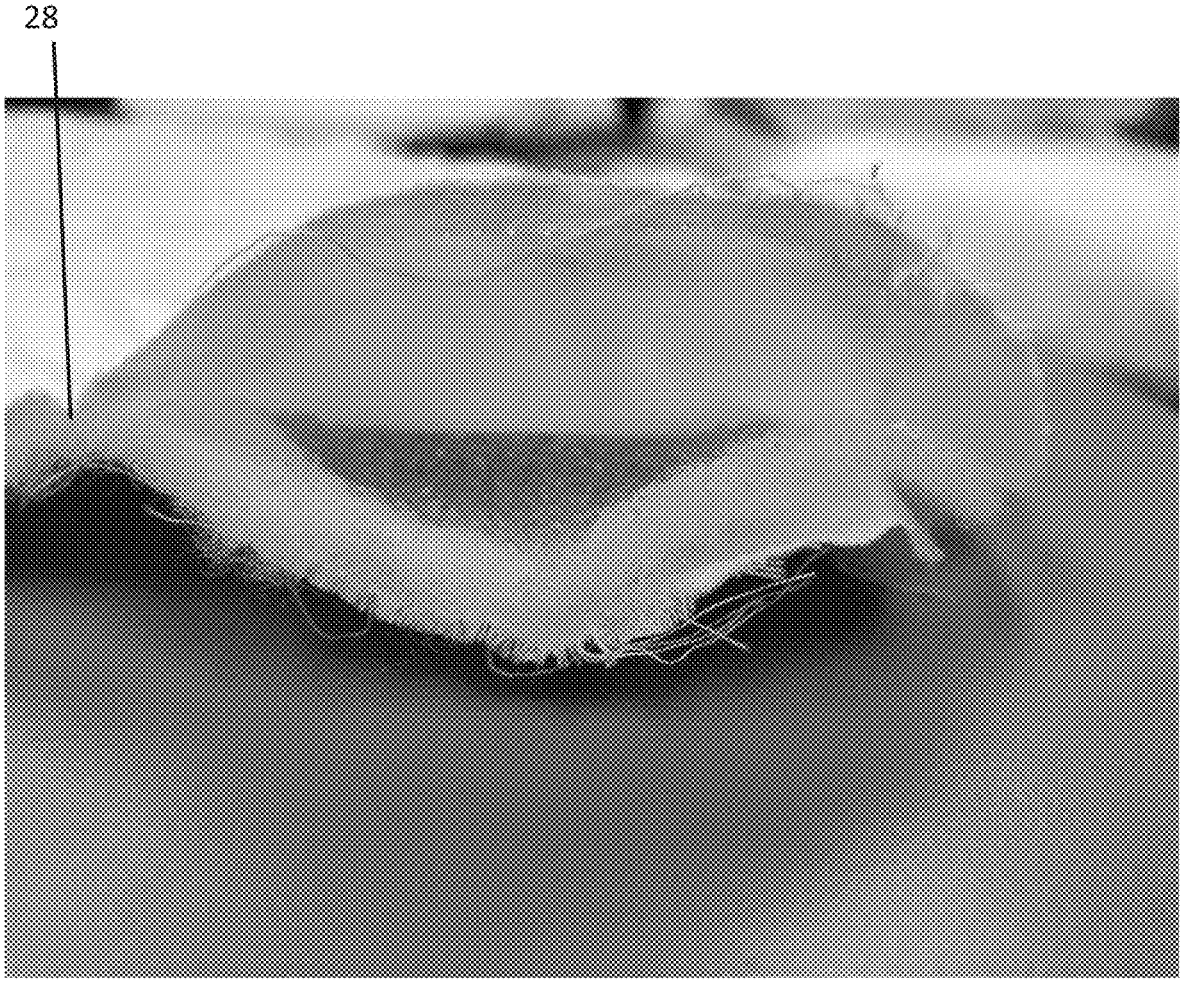

FIGS. 9-12 show cross-sectional views of an exemplary embodiment of material forming the vest 10. Particularly cross-sectional views of a chamber 18 of the material forming the vest 10 are shown. The material comprises an outermost layer 24, an inner liner 26 arranged opposite the outermost layer 24, and an interior layer 28 disposed therebetween. The outermost layer 24 comprises a material that can withstand the elements and uphold it integrity upon contact with external objects. In this example, the outermost layer is a polyester material. The inner liner 26 is composed of a synthetic material sufficient for contacting the body of the wearer. The interior layer 28 is intended to provide the vest 10 with a certain overall thickness, making the vest both comfortable to wear and providing a degree of thermal insulation. Here, the exemplary interior layer 28 comprises an acoustic polyester mesh. As shown, particularly in FIG. 10, the material forming the vest 10 includes two layers of the acoustic polyester mesh 28 which sandwich and essentially encapsulate the weighted material 22. As such, the weighted material 22 is secured within an envelope of the acoustic polyester mesh 28 and prevented from moving within the capsule 18. As shown in FIG. 12, the capsule 18 is formed by a series of compressions 30 of the material which forms the vest 10. In the exemplary embodiment, where the chambers 18 are shaped as elongated rectilinear elements, the chambers 18 are formed by generally parallel compressions 30 which extend between adjacent chambers 18. The compression 30 may be a stich, a heat weld, or any similar means which permanently pinches the material of the vest 10 together so as to create the independent chambers 18. The compressions 30 spatially isolate each chamber 18 from the others so that the weighted material 22 cannot move from one chamber 18 to another.

The weighted material 22 imparts a desired mass to the chambers 18 of the vest. In the illustrated example, the chambers are located on the front F of the vest 10 in the chest area 22, on the back B of the vest in the upper back area 14. The shoulder area 16, which extends from the front F of the vest 10 to the back B also includes the chambers 18. The weighted material 22 is disposed in all of the chambers on the chest area 22, the upper back area 14, and the shoulder area 16. The stomach area 20 of the vest 10 and the lower back area 12 do not include the chambers 18 and do not include the weighted material 22. The result is that the vest 10 has a very targeted distribution of the weighted material 22. When a user wears the vest 10, the weighted material 22 bears on the shoulder, chest, and upper back areas of the body and provides a calming, soothing, and therapeutic pressure. The total weight of the vest 10 can range from about two pounds to six pounds, depending upon the size of the vest. Vest sizes include: youth small; youth medium; youth large; youth extra large; men's small; men's medium: men's large; and men's extra large. In one embodiment, the youth small vest weights about two pounds and the men's extra large weighs about six pounds.

Herein, the weighted material 22 has been disclosed, by way of example, as the micro glass beads. However, the broad scope of the invention contemplates any material sufficient for provided the desired mass to the chambers 18 of the vest 10. For example, the weighted material 22 may be a gel.

The article of clothing has herein been described by way of example as the vest 10. However, the broad scope of the invention contemplates any article of clothing from which a therapeutic pressure is desired. For example, the article of clothing may be a jacket, shirt, pants, shorts, scarf, under garment, hat, glove, shoe, or any other desired garment.

The material forming the vest 10 is described herein as an outermost polyester layer, an inner liner formed of synthetic material, and a two layers of acoustic polyester mesh disposed therebetween. These are exemplary materials. The outermost layer may be formed of any material suitable for engaging the elements and contacting exterior surfaces and objects during use. The inner liner may be formed of any material suitable for contact with the body of the user, such as a natural material or a blend of synthetic and natural materials. The interior layers can be formed of any material sufficient to retain the weighted material and to provide comfort to the wearer.

While the preferred embodiments to the invention have been described, it will be understood that those skilled in the art, both now and in the future, may make various improvements and enhancements which fall within the scope of the claims which follow. These claims should be construed to maintain the proper protection for the invention first described.

The invention claimed is:

1. An article of clothing, comprising:

a weighted material inconspicuously disposed within a material forming the article of clothing;

wherein the weighted material is configured to apply a therapeutic pressure to the body of a user when the article of clothing is worn;

wherein the material forming the article of clothing comprises an inner liner arranged to contact the body of the user when worn, an outermost layer arranged opposite of the inner layer, and an interior layer;

wherein the weighted material is encapsulated within the interior layer;

wherein the inner liner is a synthetic fabric, the outermost layer is a synthetic fabric, and the interior layer comprises two layers of acoustic polyester mesh, and wherein the weighted material comprises glass beads and is disposed between the two layers of acoustic polyester mesh.

2. The article of clothing according to claim 1, wherein the article comprises a vest.

3. The article of clothing according to claim 2, wherein the material forming the vest is arranged to delimit chambers, wherein each chamber is spatially isolated from the others.

4. The article of clothing according to claim 3, wherein the weighted material is disposed within the chambers.

5. The article of clothing according to claim 4, wherein the weighted material is disposed in an area of the vest that aligns with the shoulders, upper back, and chest of the user when the vest is worn.

6. The article of clothing according to claim 5, wherein an area of the vest that aligns with the lower back and stomach of the user when the vest is worn does not include the weighted material.

7. The article of clothing according to claim 1, wherein the two layers of acoustic polyester mesh are arranged to delimit a plurality of chambers, wherein each chamber is spatially isolated from the others, and wherein the glass beads are disposed in the chambers.

8. The article of clothing according to claim 7, wherein the weighted material is disposed in an area that aligns with the shoulders, upper back, and chest of the user when worn, and wherein an area that aligns with the lower back and stomach of the user when worn does not include the weighted material.

9. The article of clothing according to claim 1, wherein the article comprises at least one of a vest, jacket, shirt, pants, shorts, under garment, hat, glove, scarf, and shoe.

10. A method of manufacturing an article of clothing, comprising:

disposing an interior material between a liner material and an outermost material;

delimiting the interior material into a plurality of chambers wherein each chamber is spatially isolated from the others;

disposing a weighted material within at least some of the chambers in a portion of the article of clothing arranged to apply a therapeutic pressure to the body of a user when the article of clothing is worn;

wherein the liner material is arranged to contact the body of the user when worn, the outermost layer is arranged opposite of the liner material, wherein the weighted material is encapsulated within the interior material;

wherein the liner material is a synthetic fabric, the outermost layer is a synthetic fabric, and the interior material comprises two layers of acoustic polyester mesh, and wherein the weighted material comprises glass beads and is disposed between the two layers of acoustic polyester mesh.

11. The method according to claim 10, further comprising forming the article of clothing into a vest and disposing the weighted material in an area of the vest that aligns with the shoulders, upper back, and chest of the user when the vest is worn, and not disposing the weighted material an area of the vest that aligns with the lower back and stomach of the user when the vest is worn.

12. The method according to claim 10, wherein disposing the weighted material comprises fixing a cluster of glass micro-beads within one of the chambers to the acoustic polyester mesh that forms the interior material.

13. The method according to claim 10, wherein the article of clothing comprises at least one of a vest, jacket, shirt, pants, shorts, under garment, hat, glove, scarf, and shoe.

14. A method of applying a therapeutic pressure to a person, comprising:

inconspicuously disposing a weighted material within an article of clothing;

applying the article of clothing to the person so that the weighted material bears on a predetermined area of a body of the person;

wherein the article of clothing is the article of clothing of claim 1.

15. The method according to claim 14, wherein the article of clothing comprises a vest and the weighted material is disposed in an area of the vest that aligns with the shoulders, upper back, and chest of the user when the vest is worn, and wherein the weighted material is not disposed in an area of the vest that aligns with the lower back and stomach of the user when the vest is worn.

16. The method according to claim 15, wherein the weighted material comprises glass beads discretely secured in chambers formed by the two layers of acoustic polyester mesh, wherein each chamber is spatially isolated from the others.

17. The method according to claim 14, wherein the article comprises at least one of a vest, jacket, shirt, pants, shorts, under garment, hat, glove, scarf, and shoe.

* * * * *